US007677683B2

(12) United States Patent
Iwakura

(10) Patent No.: US 7,677,683 B2
(45) Date of Patent: Mar. 16, 2010

(54) RECORDING APPARATUS

(75) Inventor: Koya Iwakura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 439 days.

(21) Appl. No.: 11/742,901

(22) Filed: May 1, 2007

(65) Prior Publication Data

US 2007/0285462 A1 Dec. 13, 2007

(30) Foreign Application Priority Data

May 11, 2006 (JP) ..... 2006-132415

(51) Int. Cl.
*B41J 25/308* (2006.01)
*B41J 23/00* (2006.01)
*B41J 11/20* (2006.01)

(52) U.S. Cl. ..... 347/8; 347/37; 400/59; 400/60

(58) Field of Classification Search ..... 347/8, 347/37; 400/59, 60

See application file for complete search history.

(56) References Cited

U.S. PATENT DOCUMENTS 6,899,474 B2 5/2005 Uchida et al.
7,101,005 B2 * 9/2006 Buonerba et al. ..... 347/8
7,114,867 B2 10/2006 Ohashi et al.
2002/0101463 A1 * 8/2002 Fairchild et al. ..... 347/8
2006/0256180 A1 * 11/2006 Asano ..... 347/104

FOREIGN PATENT DOCUMENTS

JP 7-276736 10/1995

* cited by examiner

*Primary Examiner*—Julian D Huffman
*Assistant Examiner*—Jason S Uhlenhake
(74) *Attorney, Agent, or Firm*—Fitzpatrick, Cella, Harper & Scinto

(57) ABSTRACT

A recording apparatus includes a recording head mounted on a carriage movable along a recording material, a guide member for guiding the carriage, a bearing member which is mounted to the carriage so as to be movable relative to the carriage in a vertical direction, and a slidable member mounted slidably in a carriage movement direction between the carriage and the bearing member. The slidable member is slid in the carriage movement direction to switch a height position of the carriage with respect to the guide member, whereby a gap between the recording head and the recording material is switched.

8 Claims, 10 Drawing Sheets

RECORDING APPARATUS

FIELD OF THE INVENTION AND RELATED ART

The present invention relates to a recording apparatus for recording an image on a recording material with a recording head mounted to a carriage movable along the recording material, particularly a recording apparatus capable of switching a gap between the recording head and the recording material.

Generally, a recording apparatus having the functions of a printer, a copying machine, a facsimile apparatus, or the like is constituted so that an image (including characters, symbols, etc.) is formed on a recording material such as paper, a cloth, a plastic sheet, an OHP sheet, or an envelope by a recording head on the basis of image information. A scanning method in the recording apparatus includes those of a serial-type and a line-type. The serial-type scanning method is a method in which an image is recorded by alternately repeating main scanning for moving the recording head along the recording material and subscanning for feeding the recording material at a predetermined pitch. The line-type scanning method is a method in which an image is recorded only by the feeding of the recording material (subscanning) while an image portion corresponding to one line is recorded collectively. Further, the recording apparatus is classified into those of an ink jet type, a thermal transfer type, a laser beam type, a thermal (heat-sensitive) type, a wire dot type, etc. In the case of the serial-type recording apparatus, generally, the recording head is mounted on a carriage moved in a main scanning direction and an image is recorded by driving the recording head in synchronism with the movement of the carriage. By alternately repeating recording of an image portion corresponding to one line and feeding of the recording material in a predetermined amount, recording on the entire recording material is effected.

In the above described recording apparatuses, there is such a recording apparatus that recording is effected on a thick recording material such as an envelope or thick paper. In the case of effecting recording on the thick paper, a distance (or a gap) between the recording head and the recording material is excessively small, so that the recording head rubs the recording material in some cases. However, in order to obviate this phenomenon, it is very difficult to decrease the gap to such a degree that the gap is smaller than a certain value. Further, in recent years, a high image quality is increasingly achieved and specialty paper such as glossy paper requires recording thereon with a further decreased gap between the recording head and the recording material. In order to compatibly meet such mutually contradictory requirements, e.g., Japanese Laid-Open Patent Application (JP-A) Hei 7-276736 and U.S. Pat. No. 6,899,474 have disclosed the following constitutions.

JP-A Hei 7-276736 has disclosed a constitution in which a sliding member slidably and rotatably supported by a chassis of an apparatus main assembly is mounted at an upper portion of a carriage unit. The sliding member is provided with a plurality of surfaces different in distance from the center of rotation. By switching a sliding surface of the sliding member with the chassis by rotating the sliding member, the carriage is rotated about a guide shaft to switch a gap between a recording material and a recording head. As a result, the gap between the recording material and the recording head can be increased when recording on a thick recording material such as an envelope is effected and can be decreased when recording on specialty paper such as glossy paper is effected.

U.S. Pat. No. 6,899,474 has disclosed a constitution in which a guide shaft is provided with cams at both ends and a chassis of an apparatus main assembly is provided with a cam abutment surface and in such a state that the guide shaft is positioned with respect to the chassis in a subscanning direction, the guide shaft is displaceable in a vertical direction. In this constitution, the cams are rotationally driven, whereby it is possible to change a height position (level) of the carriage without changing a position of the guide shaft in the subscanning direction.

However, the above described conventional constitutions have encountered the following problems.

In the constitution disclosed in JP-A Hei 7-276736, the gap between the recording head and the recording material is adjusted by rotating the sliding member mounted at the upper portion of the carriage unit to rotate the carriage about the guide shaft. For this reason, at least one of the switched positions, the carriage is inclined with respect to the recording material, so that it is difficult to effect high-quality image recording at a level exceeding a certain level. Further, the sliding member for switching the gap is required to be constituted separately from the carriage. For this reason, between the chassis and sliding member of the carriage, a parts tolerance for one part is required. As a result, particularly when recording is effected on specialty paper such as glossy paper requiring recording quality, the gap between the recording head and the recording material is less controllable with sufficient accuracy.

In the constitution disclosed in U.S. Pat. No. 6,899,474, the guide shaft is required to be a cylindrical shaft and a spring for downwardly urging the guide shaft and the cams provided at both ends of the guide shaft. Further, a driving source for rotating the cams is also required. As a result, the constitution is complicated, thus increasing costs.

SUMMARY OF THE INVENTION

A principal object of the present invention is to provide a recording apparatus capable of readily switching a gap between a recording head and a recording material by a simple and inexpensive constitution without inclining a carriage with respect to the recording material.

Another object of the present invention is to provide a recording apparatus capable of effecting high-quality image recording regardless of a type of the recording material.

According to an aspect of the present invention, there is provided a recording apparatus for effecting recording on a recording material with a recording head mounted on a carriage movable along the recording material, the recording apparatus comprising:

a guide member for guiding the carriage;

a platen for guiding the recording material at a position opposite to the recording head;

a bearing member, mounted to the carriage, movable relative to the carriage in a vertical direction; and a slidable member mounted slidably in a carriage movement direction between the carriage and the bearing member, wherein the slidable member is slid in the carriage movement direction to move the bearing member relative to the carriage thereby to change a distance between the recording head and the platen.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
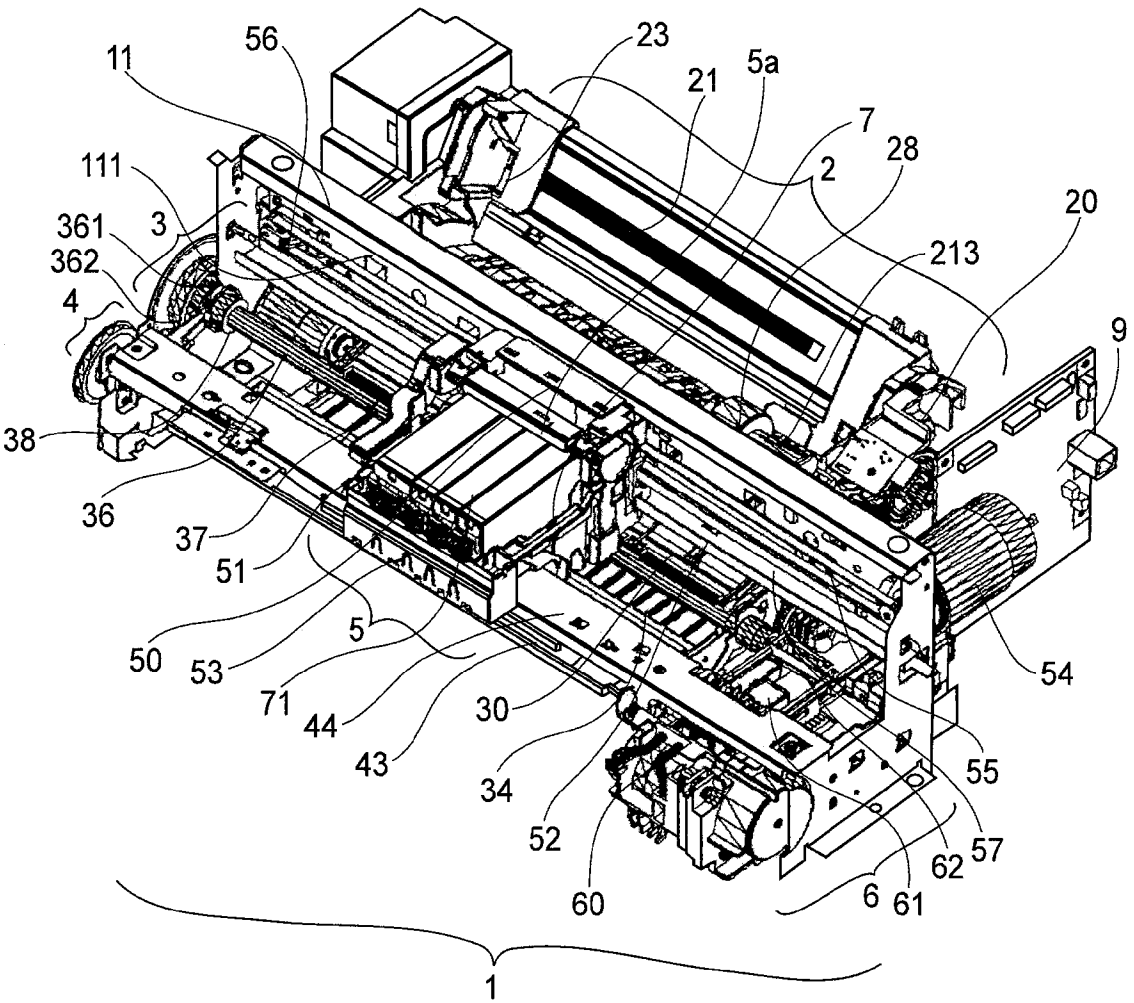
FIG. 1 is a schematic perspective view showing an embodiment of the recording apparatus according to the present invention.

Hereinbelow, embodiments of the present invention will be described with reference to the drawings. In the drawings, the same reference numerals or symbols represent the same or corresponding members or portions.

Figure 2:
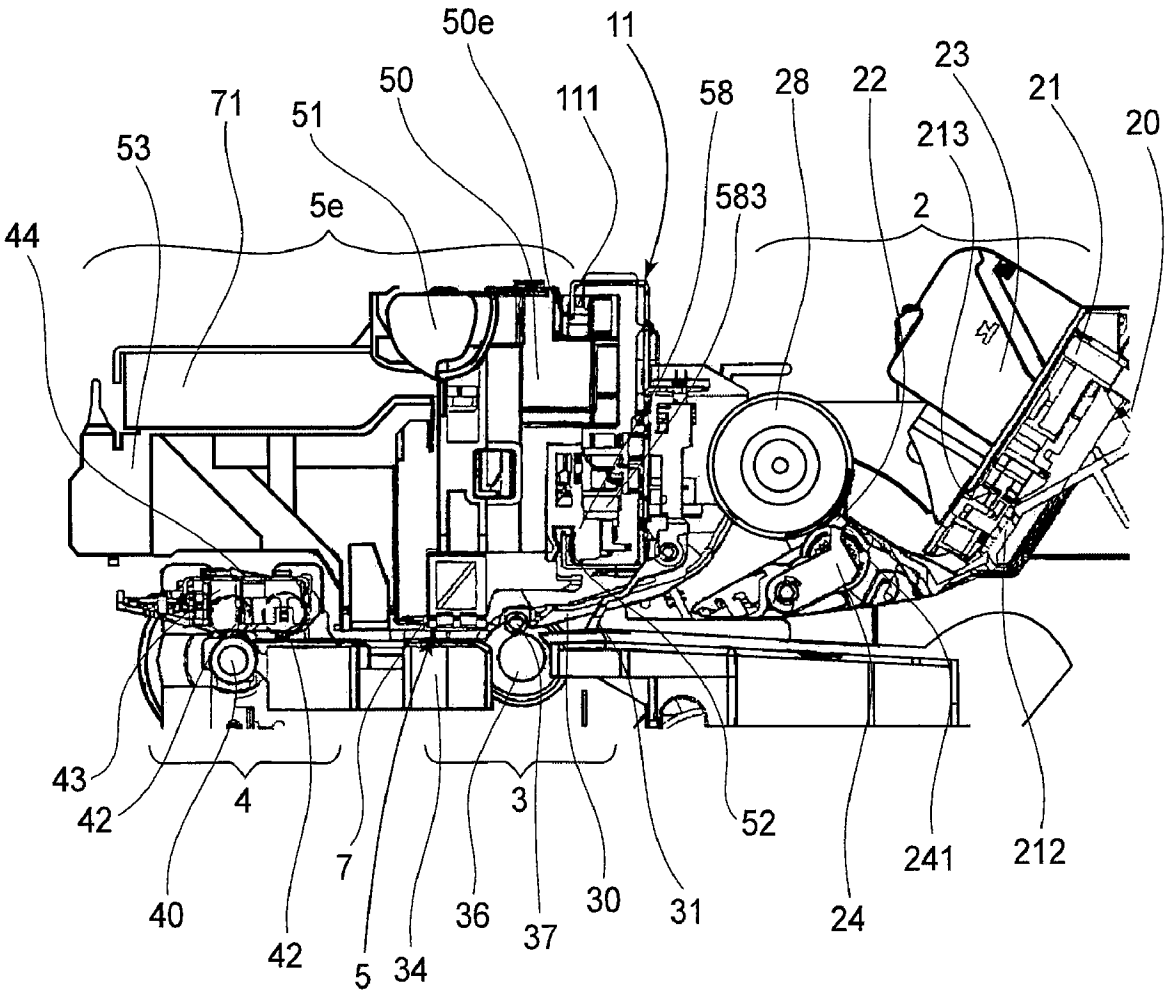
FIG. 2 is a schematic longitudinal sectional view showing an embodiment of the recording apparatus of the present invention.

FIG. 1 is a perspective view showing an embodiment of the recording apparatus according to the present invention, and FIG. 2 is a longitudinal sectional view showing an embodiment of the recording apparatus of the present invention. FIGS. 1 and 2 illustrate an ink jet recording apparatus as the recording apparatus of the present invention.

Referring to FIGS. 1 and 2, a recording apparatus 1 of this embodiment includes a sheet pickup portion 2, a sheet feed portion 3, a sheet discharge portion 4, a recording portion 5, and a refreshing process portion 6. The recording portion constitutes a recording means. The recording apparatus 1 is of a serial-type in which an image is formed while a surface of a recording material is scanned with a recording head 7 mounted to a reciprocable carriage 50. Further, to a main assembly of the recording apparatus 1, an electric portion 9 including an electric substrate or the like, on which a control circuit is mounted, is attached.

First, the sheet pickup portion 2 will be described. The sheet pickup portion 2 is constituted by attaching a pressure plate 21 for stacking thereon the recording material such as recording sheets or the like, a sheet pickup roller 28 for picking up the recording material, a separation roller 241 for separating the recording material into a single sheet, a return lever for returning the recording material to a mounting position, and the like to a sheet pickup base 20. To the sheet pickup base 20 or an apparatus outer casing (not shown), a sheet supply tray (not shown) for mounting and holding thereon the recording material is also attached. The sheet pickup roller 28 has a circular cross section and is disposed at a position close to a reference surface for regulating a position of the recording material in a width direction. A driving force for the sheet pickup roller 28 is transmitted via a gear train from an LF motor (not shown), as a driving source for the sheet feed portion 3 (described later), provided to the sheet pickup portion 2.

To the pressure plate 21, a movable side guide 23 for regulating the mounting position of the recording material is provided movably. The pressure plate 21 is rotatable about a rotation shaft (rotational axis) provided to the sheet pickup base 20 and is urged toward the sheet pickup roller 28 by a pressure plate spring 212. At a portion of the pressure plate 21 opposite to the sheet pickup roller 28, a separation sheet 213 formed of a large friction coefficient material for preventing double pickup of the recording material is provided. The pressure plate 21 is driven so as to be pressed against and moved apart from the sheet pickup roller 28 by a pressure plate cam (not shown). By the sheet pickup base 20, a separation roller holder 24 to which the separation roller 241 is attached is rotatably supported. Further, the separation roller 241 is urged against the sheet pickup roller 28 by a separation roller spring (not shown).

The separation roller 241 includes a clutch spring (not shown) as a torque limiter and rotates when a torque load is not less than a predetermined value. Further, the separation roller 241 is supported by a separation roller release shaft (not shown) and a control cam (not shown) so that it can be pressed against and moved apart from the sheet pickup roller 28. At a position close to the sheet pickup roller 28 on the sheet pickup base 20, the return lever 22 for returning sheets of the recording material other than an uppermost sheet to the mounting position is rotatably attached to the sheet pickup base 20. The return lever 22 is urged toward a release direction by a return lever spring (not shown) and can return the recording material by being rotated by the control cam (not shown). In an ordinary standby state, the pressure plate 22 is released by a pressure roller cam and the separation roller 241 is released by the control cam (not shown). The return lever 22 is provided at a position for blocking a mounting opening so as not to further push the mounted recording material toward the sheet feed portion 3.

When a sheet pickup operation is started from the standby state, first, the separation roller 241 is caused to press-contact the sheet pickup roller 28 by the drive of the motor. Then, the return lever 22 is released to press the pressure plate 21 against the sheet pickup roller 28. In this state, pickup of the recording material is started. The recording material is limited in movement by a preliminary separation portion provided to the separation roller holder 24, so that only a predetermined number of sheets of the recording material are sent to a nip (portion) between the sheet pickup roller and the separation roller 241. The sent recording material is separated in the nip and only an uppermost sheet of the recording material is picked up and sent toward a feed roller 26 of the sheet feed portion 3. When the recording material reaches a nip between the feed roller 36 and pinch rollers 37, the pressure plate 21 is released by the pressure plate cam (not shown) and the separation roller 241 is released by the control cam (not shown). Further, the return lever 22 is returned to the mounting position by the control cam (not shown). At this time, the recording material which has reached the nip between the sheet pickup roller 28 and the separation roller 241 can be returned to the mounting position by the movement of the return lever 22.

Next, the sheet feed portion 3 will be described. The sheet feed portion 3 includes the feed roller 36 for feeding the recording material, a paper end (PE) detection sensor (not shown), etc. The feed roller 36 has a structure in which a metal shaft is surface-coated with ceramic fine particles and is rotatably supported by bearings 38 on the chassis 11 side at both metal end portions. Between the bearing 38 and the feed roller 36, a roller tension spring (not shown) for applying a predetermined torque load to the feed roller 36 is mounted. As a result, rotation of the feed roller 36 can be stabilized to ensure stable feeding.

To the feed roller 36, a plurality of pinch rollers 37 are pressed against so as to be rotatable by the rotation of the feed roller 36. Each of the pinch rollers is held by a pinch roller holder 30 and pressed toward the feed roller 36 by a pinch roller spring (not shown), so that a feeding force for the recording material is generated. In this case, a rotation shaft of the pinch roller holder 30 is rotatably attached to the bearings of the chassis 11. The pinch roller holder 30 is provided with a sensor lever 31 for transmitting detection of a leading end and trailing end of the recording material to the PE sensor. On a downstream side of the feed roller 36 in a sheet feed direction, a platen 34 for guiding and supporting the recording material during recording is disposed. The platen 34 is attached to the chassis 11.

The recording material picked up by the sheet pickup portion 2 is sent into the nip between the feed roller 36 and the pinch rollers 37 while being guided by the pinch roller holder 30. At this time, the feed roller 36 is yet stopped, and initial feeding (end alignment) of the recording material is performed by feeding the recording material by a predetermined amount in a state in which the leading end of the recording material reaches the nip. Further, at this time, the sensor lever 31 detects the leading end of the recording material and determines a recording start position of the recording material. Further, the feed roller 36 is rotated by the LF motor to feed the recording material to the recording start position on the platen 34. On the platen 34, a rib constituting a reference feed surface is formed. By this arrangement constitution of the rib, the gap (distance) between the recording material and the recording head 7 is controlled and waving of the recording material is regulated in cooperation with the sheet discharge portion 4 described later.

The feed roller 36 is driven by transmitting a rotational force of a DC motor as the LF motor (Not shown) to a pulley 361 provided to the roller shaft of the feed roller 36 via a timing belt (not shown). Further, the roller shaft of the feed roller 36 is provided with a code wheel 362 for detecting a feed amount. At an outer peripheral portion of the cord wheel 362, marking is provided at a pitch of 150-300 lines per one inch of circular arc length. An encoder sensor (not shown) for reading this marking is attached to the chassis 11 at a position adjacent to the code wheel 362.

Next, the recording portion 5 will be described. At a position which is downstream from the feed roller 36 in the sheet feed direction and opposite to the platen 34, the recording head 7 for forming (recording) an image is provided. The recording head 7 is mounted to the carriage 50 reciprocable in the width direction of the recording material. That is, the recording apparatus of this embodiment employs the serial-type recording method. The recording portion 5 is constituted by a carriage unit 50*a*, including the carriage 50 and the recording head 7 and the like mounted on the carriage 50, and a driving mechanism for the carriage unit 50*a*. Further, the recording portion 5 includes the platen 34 for guiding and supporting the recording material at a position opposite to the recording head 7. In this embodiment, as the recording head 7, an ink jet recording head capable of color recording is used. For this reason, the recording head 7 is constituted by a plurality of recording heads corresponding to colors of inks used. To each of the recording heads, a separate ink container (tank) 71 is replaceably mounted.

The recording head 7 is the ink jet recording head for recording an image by ejecting ink from an ejection outlet to the recording material on the basis of image information. It is necessary to provide a predetermined distance (gap) (of, e.g., about 0.5-3.0 mm) for jetting ink droplets between an ink ejecting portion (an ink ejection surface at which a plurality of ejection outlets are arranged) of the recording head and a recording surface of the recording material. Further, as the recording material, it is possible to use various materials such as paper, a cloth, a plastic sheet, an OHP sheet, and an envelope so long as the material can form thereon an image with the ejected ink droplets. Further, as an ink ejecting method for the recording head 7, it is possible to employ any method selected from various methods using an electrothermal transducer, an electromechanical transducer, and the like as an ejection energy generation means. For example, as the recording head 7 in this embodiment, a recording head which ejects ink by heating the ink in the ejection outlet by a heater or the like as the electrothermal transducer and by utilizing film boiling of the ink due to this heat is used. More specifically, the recording head 7 records an image on the recording material by selectively ejecting ink from the respective ejection outlets of the recording head 7 to the recording material by a change in pressure caused by growth or contraction of bubbles generated in ink by heating.

As described above, the carriage unit 50*a* is constituted by mounting the recording head 7 and the like to the carriage 50. The recording head 7 is located and held at a predetermined position on the carriage 50 by a head setting lever 51. The carriage unit 5*a* is guided and supported reciprocably in a main scanning direction perpendicular to the sheet feed direction (subscanning direction) of the recording material by a guide member (guide rail) 52 provided to the apparatus main assembly and a sliding portion 111 of the chassis 11 of the apparatus main assembly. In this case, the carriage unit 5*a* is guided and supported in a state in which an abutment (contact) surface provided at an upper portion of the carriage 50 contacts the sliding portion 111 of the chassis 11.

Figure 3:
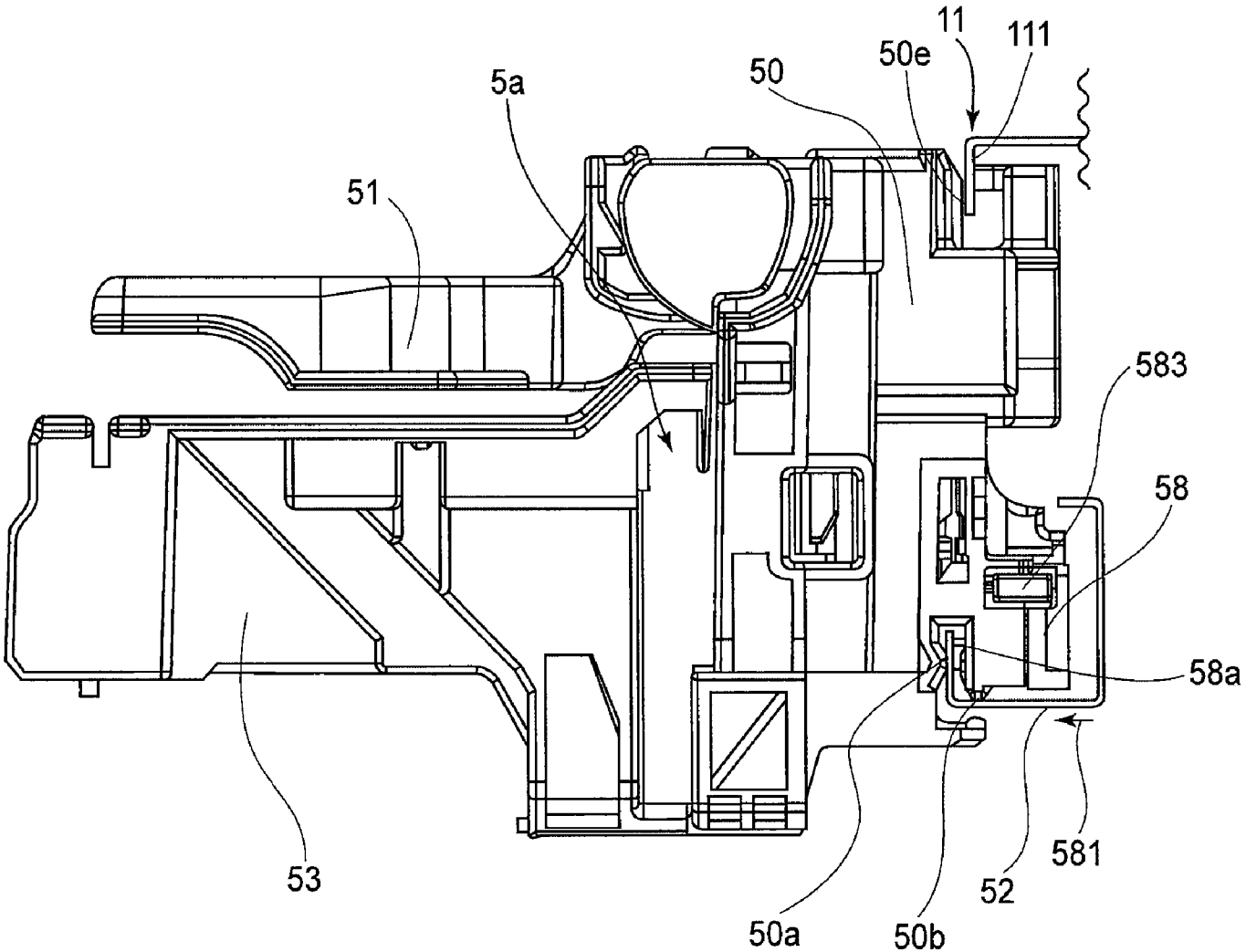
FIG. 3 is a schematic side view of a carriage unit shown in FIG. 2.
Figure 4:
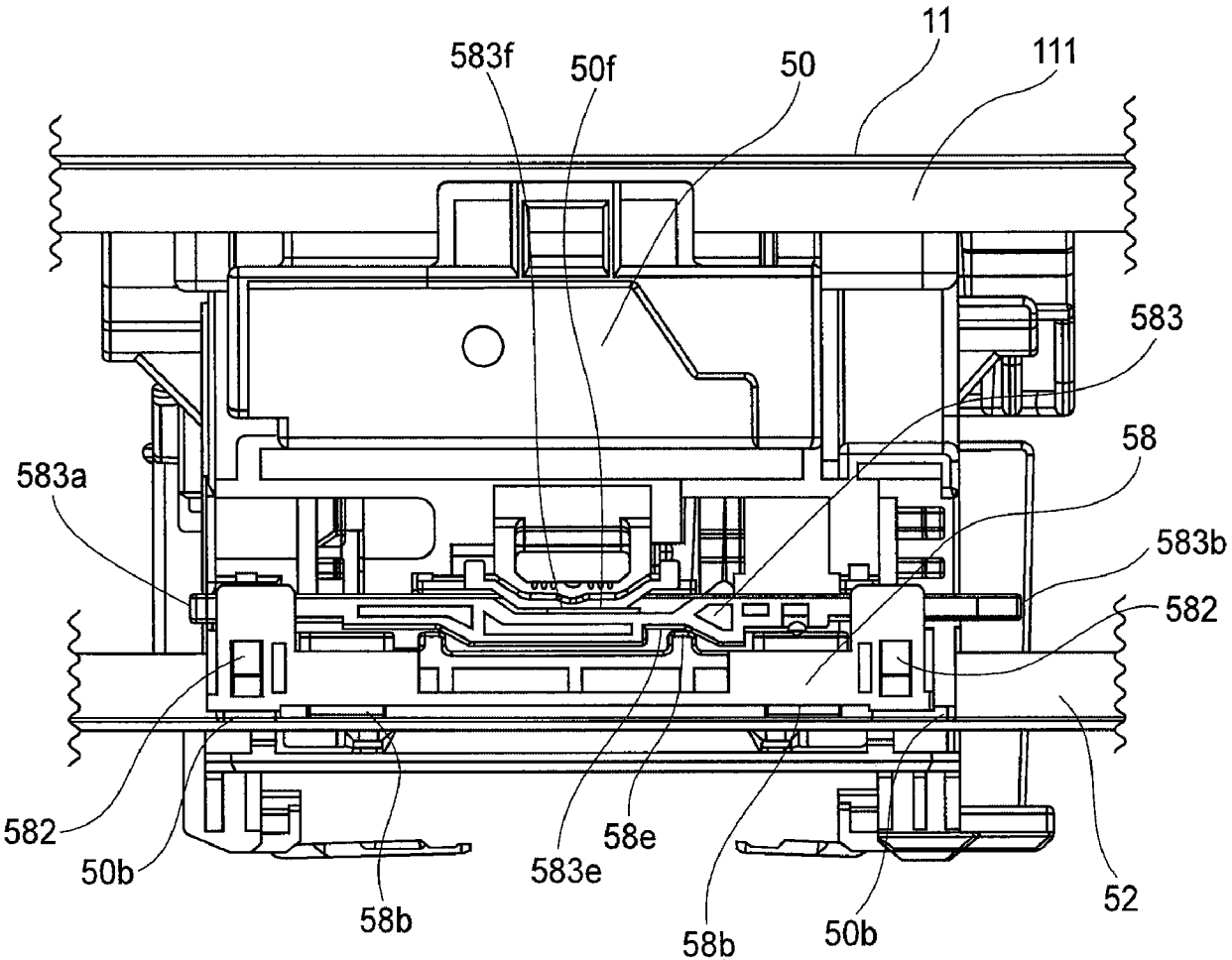
FIG. 4 is a schematic rear view of the carriage unit shown in FIG. 3.

FIG. 3 is a side view of the carriage unit 51*a* shown in FIG. 2. FIG. 4 is a rear view of the carriage unit 51*a* shown in FIG. 3.

In FIGS. 1-4, the guide rail 52 has a substantially L-shaped cross section. To the carriage 50*m* a bearing member 58 slidable relative to the guide rail 52 is attached. The bearing member 58 is attached to the carriage 50 so as to be displaceable relative to the carriage 50 in a vertical direction. Further, the bearing member 58 is a member for stabilizing its attitude with respect to the guide rail in the subscanning direction of the carriage 50. For this reason, a spring 581 for urging the bearing member 58 toward a downstream side in the recording material feed direction. More specifically, the guide rail 52 provided to the apparatus main assembly is interposed between the carriage 50 and the bearing member 58 by an urging force of the spring 581, so that the attitude of the carriage 50 in the subscanning direction is stabilized.

At a lower portion of the carriage 50, a sliding surface (in a height (vertical) direction) 50*b* contactable with a horizontal portion of the guide rail 52 is formed. Further, at a lower portion of the bearing member 58, a sliding surface (in a height (vertical) direction) 58*b* is contactable with the horizontal portion of the guide rail 52. These vertical sliding surfaces 50*b* and 58*b* can regulate a vertical position of the carriage 50 by contact with the guide rail 52 by weights of the carriage 50 and parts mounted thereon. Further, the attitude of the carriage 50 in a rotational direction is stabilized by causing the abutment surface 50*e* provided at the upper portion of the carriage 50 to the sliding portion 111 of the chassis 11.

Incidentally, positional adjustment of the carriage 50 is effected by adjusting a mounting position of the guide rail 52 with respect to the chassis 11 in a factory.

To the carriage 50, a carriage cover 53 is attached. The carriage cover 53 functions as a guide member when a user mounts the recording head 7 to the carriage 50. The carriage cover 53 also functions as a member for holding the ink container 71. The carriage 50 is driven by a carriage motor 54 attached to the chassis 11 via a timing belt 55. The timing belt 55 is stretched around an idle pulley 56 provided opposite from the carriage motor 54 under a certain tension, and is connected to the carriage 50. A code strip 57 for detecting the position of the carriage 50 is extended in parallel to the timing belt 50. The code strip 57 has marks making at a pitch of, e.g., 150-300 lines per inch. On the carriage 50, an encoder sensor (not shown) for reading the marking of the code strip 57 is mounted.

The bearing member 58 switches a height position (level) of the carriage 50 with respect to the guide rail 52 by being vertically displaced relative to the carriage 50 as described later. By the switching of the height position of the carriage 50, it is possible to switch a gap which is a distance between the recording head 7 and the recording material. A constitution and operation of the gap switching by the bearing member 58 will be described later.

When the image is formed on the recording material by the above described constitution, the recording material is fed to the recording start position (in the sheet feed direction) by the pair of feed rollers 36 and 37. At the same time, the carriage 50 is moved to the recording start position (in a direction perpendicular to the sheet feed direction) by the carriage motor 54. As a result, the recording head 7 is set at the recording start position. Then, by signals from the electric portion 9, while controlling drive of the recording head 7, synchronizing drive of the carriage 50, drive of the feed roller 36, and the like on the basis of image information, an image is recorded by ejecting ink from the recording head 7 to the recording material.

Next, the sheet discharge portion 4 will be described. The sheet discharge portion 4 includes a sheet discharge roller 40 disposed downstream from the recording head 7 in the sheet feed direction, spurs 42 rotatable in contact with the sheet discharge roller 40 at a predetermined pressure by the rotation of the sheet discharge roller 40, a gear train for transmitting a driving force from the feed roller 36 to the sheet discharge roller 40, and the like. In this embodiment, the sheet discharge roller 40 is attached to the platen 34. The sheet discharge roller 40 has a structure in which a plurality of roller rubber portions are provided to a metal shaft. The sheet discharge roller 40 is driven in synchronism with the feed roller 36 by transmitting a driving force of the feed roller 36 thereto via an idler gear. The plurality of spurs 42 are provided in correspondence with the plurality of roller rubber portions of the sheet discharge roller 40. Each of the spurs 42 has a structure in which a thin plate of SUS stainless steel provided with a plurality of projections at its peripheral portion is integrally formed with a resin material portion. These spurs 42 are attached to a spur holder 43 by a spur spring (not shown) consisting of a bar-like coil spring. Further, by the spur spring, the spurs 42 are caused to pressure-contact the sheet discharge roller 40.

The plurality of spurs 42 are classified into two types in terms of function. One type thereof principally generates a feeding force for the recording material by being pressed against the respective roller rubber portions. The other type thereof principally suppresses rising of the recording material during the recording by being disposed between the respective roller rubber portions. Further, in order to suppress deformations of the spur holder 43 and the chassis 11, a spur stay 44 formed of a plate-like metal member is attached to the spurs 42. By the above described constitutions, the recording material on which the image has been formed at the recording portion 5 is nipped and conveyed between the sheet discharge roller 40 and the spurs 42 to be discharged to a sheet discharge tray (not shown) outside the apparatus main assembly.

Next, the refreshing process portion 6 will be described. In the ink jet recording apparatus, the refreshing process portion 6 for keeping and refreshing an ink ejection performance while preventing clogging of the ejection outlets of the recording head 7 is provided. The refreshing process portion 6 includes a suction pump 60, a cap 61, and a wiper 62. The cap 61 decreases a degree of drying of ink of the recording head 7 by hermetically contacting the ejection surface of the recording head 7 to cover the ejection outlets. The suction pump 60 is actuated in a hermetically covered state of the ejection outlets with the cap 61 to suck the ink from the ejection outlets, thus refreshing the ink in the ejection outlets. The wiper 62 wipes the ink off the surface of the ejection outlets of the recording head 7 to clean the ejection outlets. As the suction pump 60, it is possible to use not only a piston type pump and a cylinder type pump but also, e.g., such a tube pump that a negative pressure generated in a tube is caused to act on the ejection outlets by drawing the tube connected to the cap 61.

Figure 5:
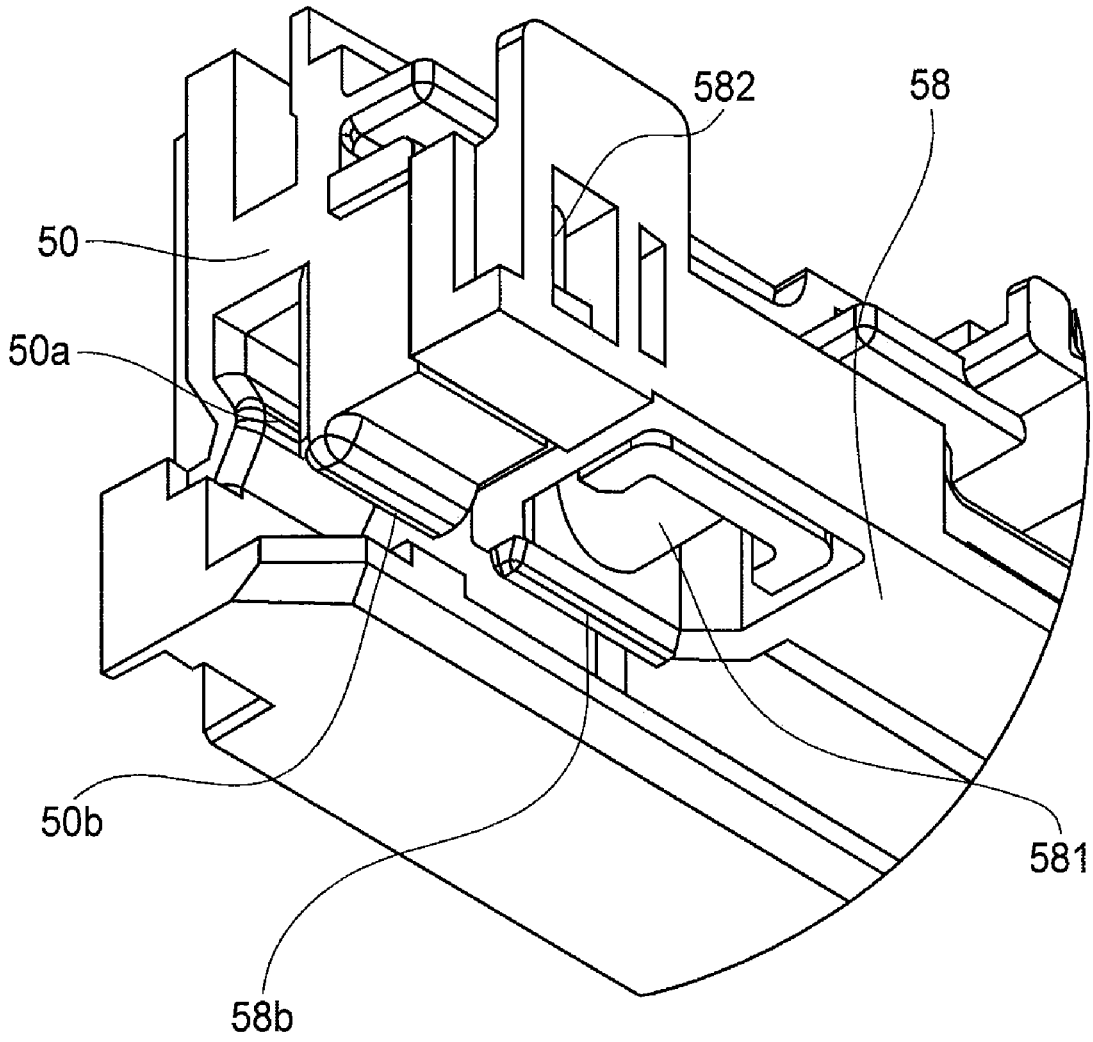
FIG. 5 is a schematic perspective view of a carriage and a bearing member which are shown in FIG. 3.
Figure 6:
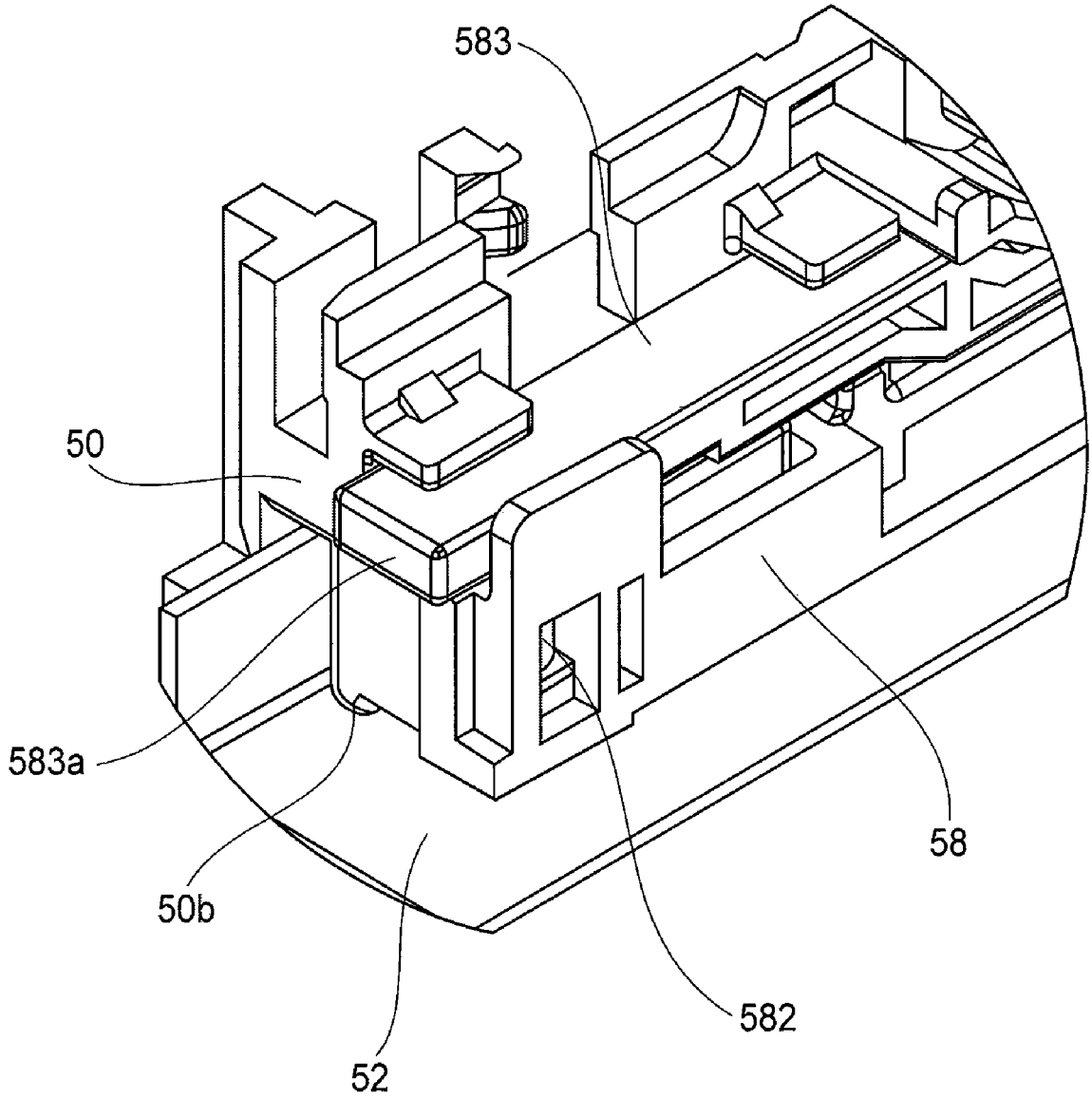
FIG. 6 is a schematic perspective view of the carriage, the bearing member, and a slidable member which are shown in FIG. 3.
Figure 7:
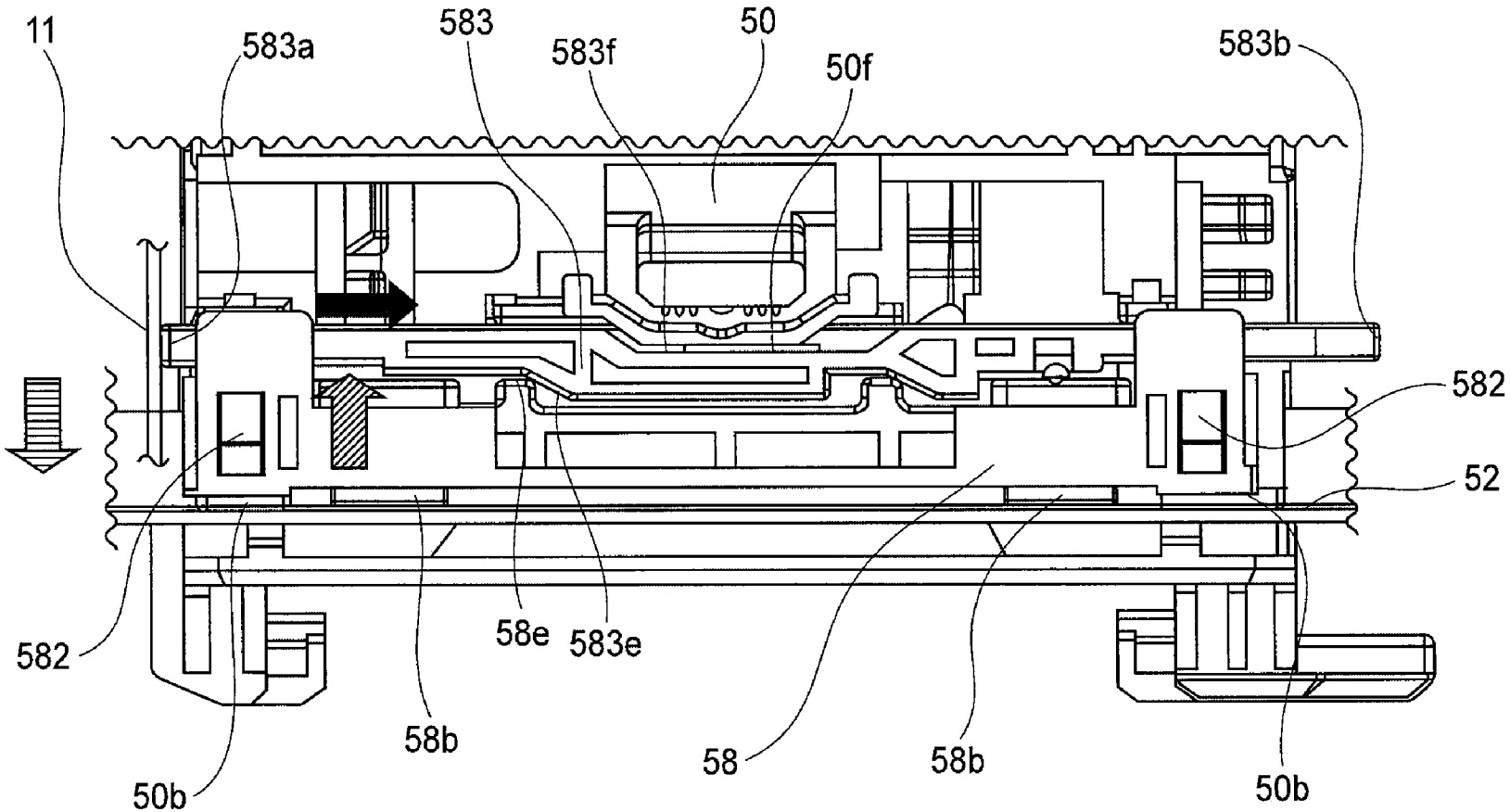
FIG. 7 is a schematic rear view when a gap of a switching mechanism for switching a gap between a recording head and a recording material which are shown in FIG. 2 is increased.
Figure 8:
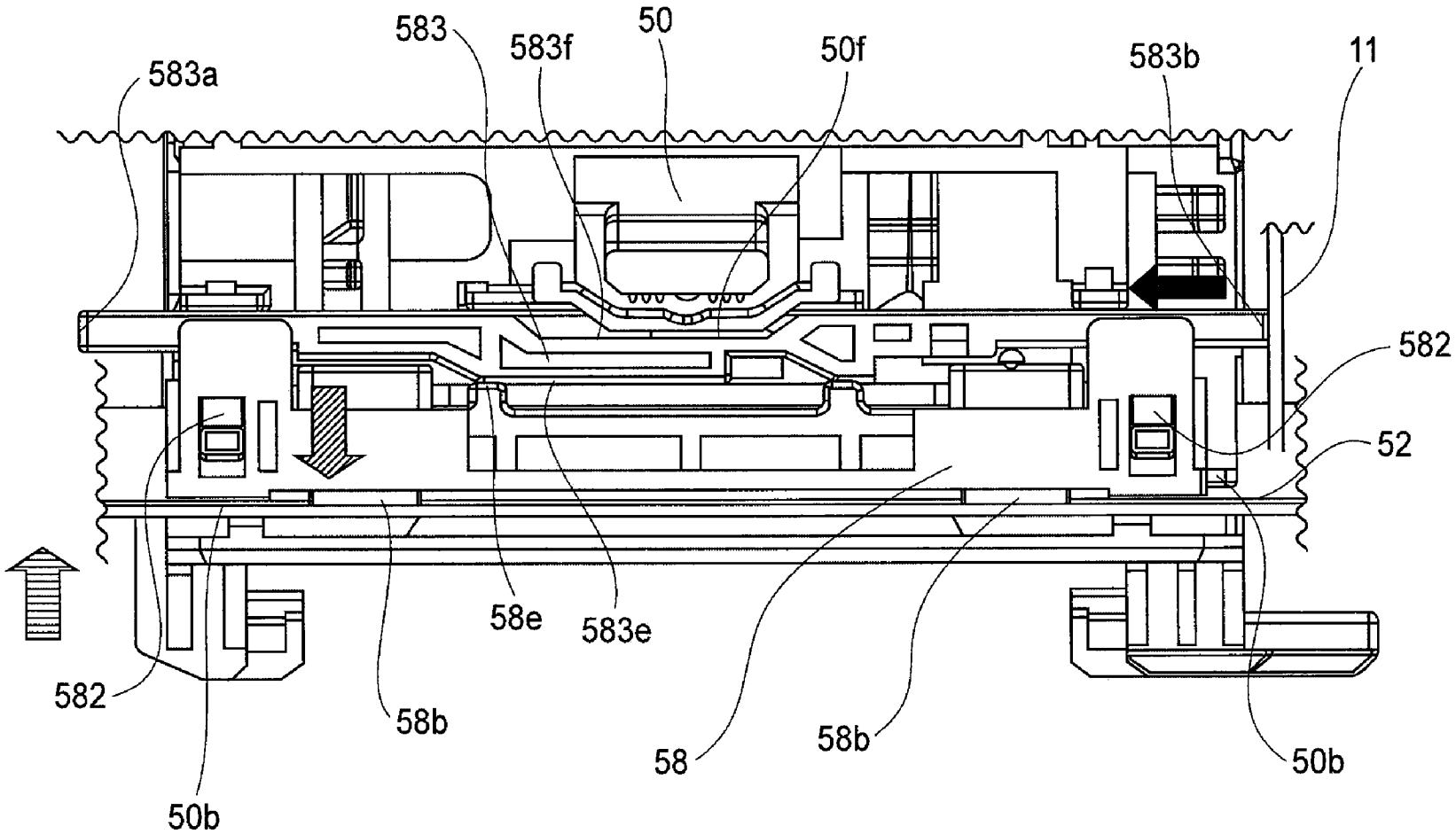
FIG. 8 is a schematic rear view when the gap of the switching mechanism shown in FIG. 7 is decreased.
Figure 9:
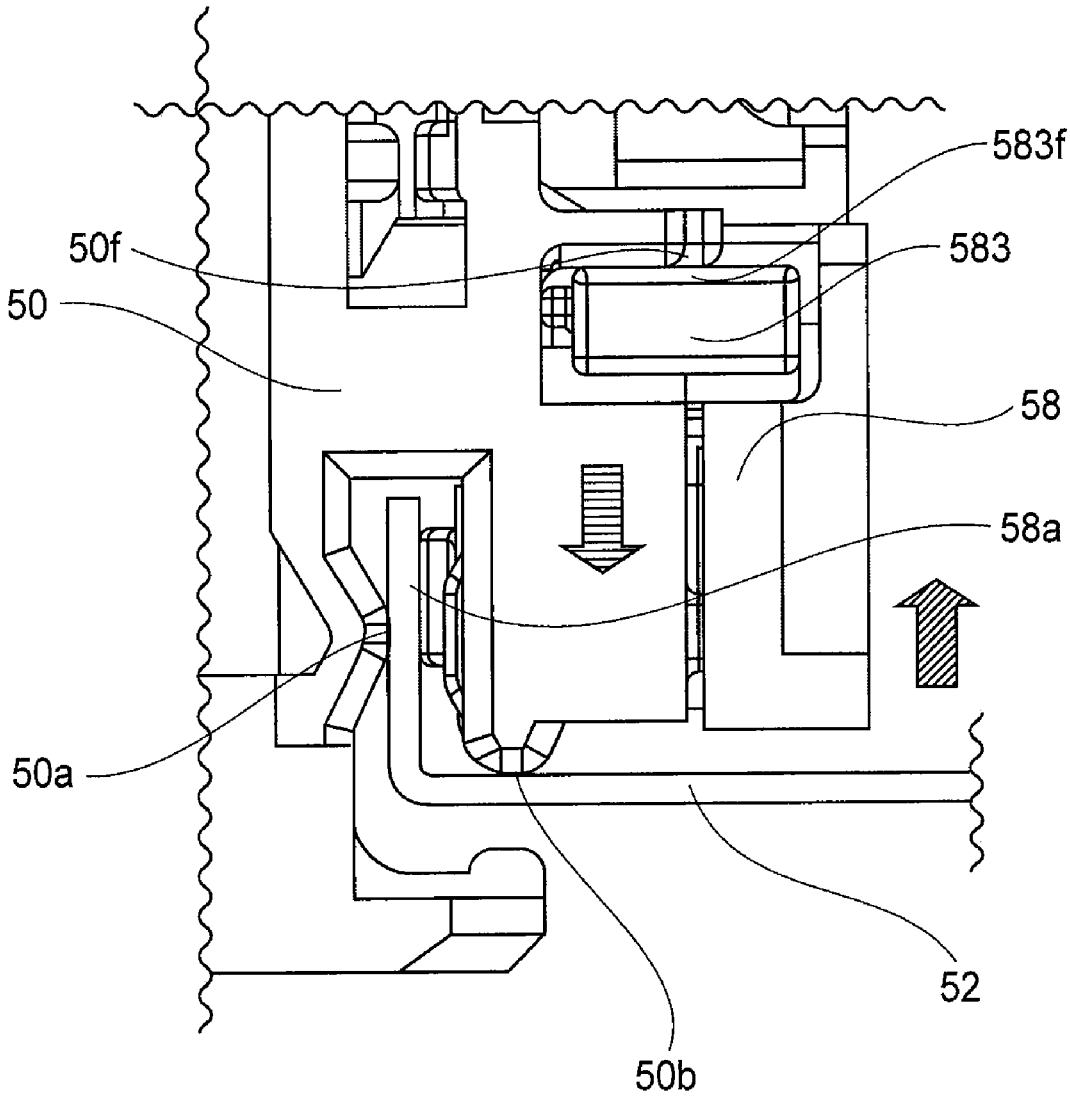
FIG. 9 is a schematic side view when the gap of the switching mechanism shown in FIG. 7 is increased.
Figure 10:
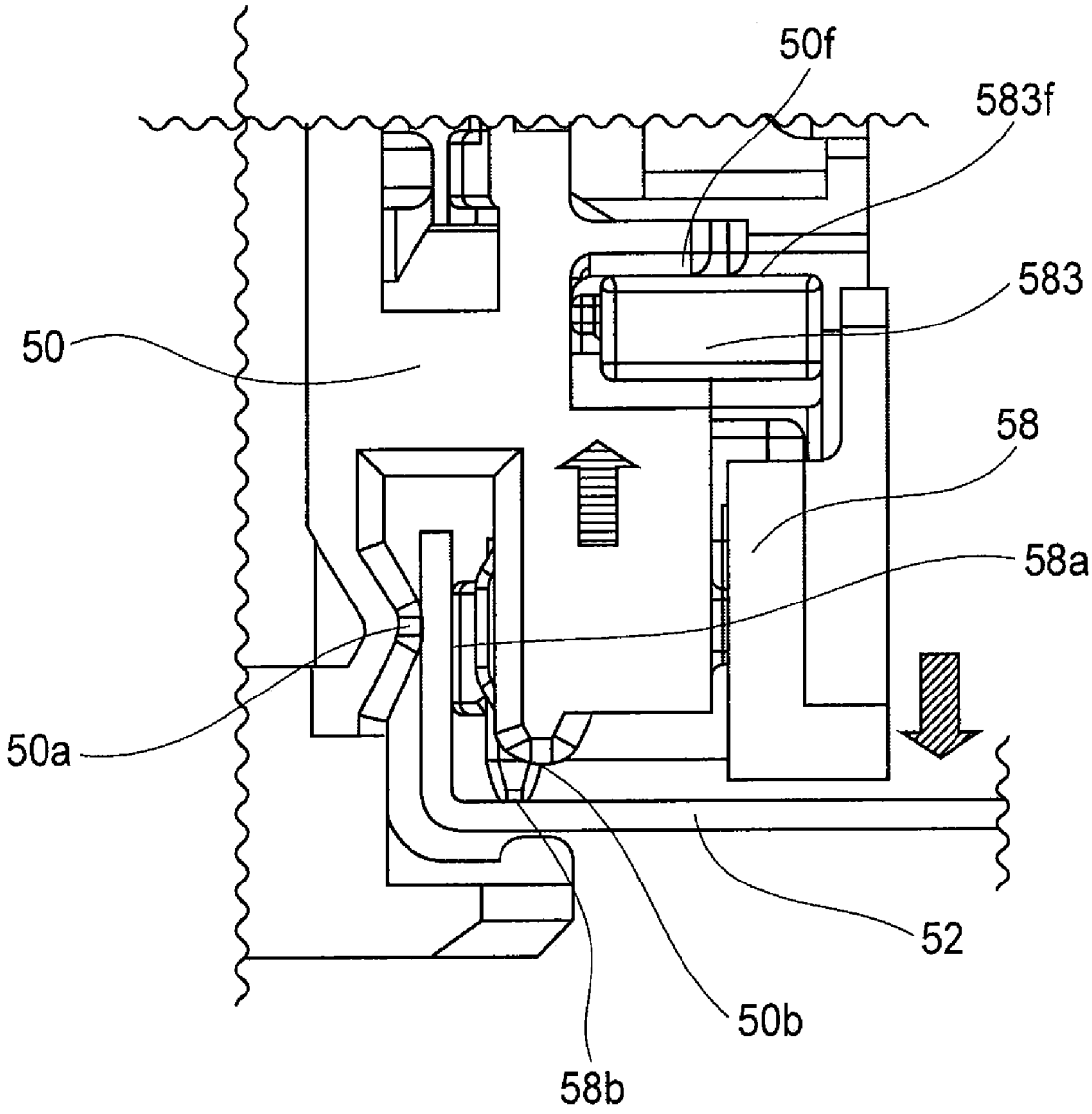
FIG. 10 is a schematic side view when the gap of the switching mechanism shown in FIG. 9 is decreased.

FIG. 5 is a perspective view of the carriage 50 and the bearing member 58 shown in FIG. 3. FIG. 6 is a perspective view of the carriage 50, the bearing member 58, and the slidable member 52 shown in FIG. 3. FIG. 7 is a rear view when a gap of the switching mechanism for switching the gap between the recording head and the recording material shown in FIG. 2 is decreased. FIG. 8 is a rear view when the gap of the switching mechanism shown in FIG. 7 is increased. FIG. 9 is a side view when the gap of the switching mechanism shown in FIG. 7 is decreased. FIG. 10 is a side view when the gap of the switching mechanism shown in FIG. 9 is increased.

Next, with reference to FIGS. 1-8, the constitution and operation of the bearing member 58 for switching the distance (gap) between the recording head 7 and the recording material will be described. In FIGS. 3-8, the carriage 50 is guided and supported by the guide rail 52 and the sliding portion 111 which are provided to the chassis 11 so that it is reciprocable in a stable attitude.

To an upstream rear surface of the carriage 50 in the sheet feed direction, as shown in FIG. 3, the bearing member 58 having the L-shaped cross-section is attached so that it is displaceable relative to the carriage 50 in the vertical direction with the longside perpendicular surface of the L-shaped cross-section toward the upstream side in the sheet feed direction. Between the carriage 50 and the bearing member 58, a spring 581 for urging the bearing member 58 toward the downstream side in the feed direction (in a left-hand direction in FIG. 3) with respect to the carriage 50 is attached. By the urging force of the spring 581, the guide rail 52 provided to the chassis 11 is sandwiched and nipped between the feed direction sliding surface 50*a* of the carriage 50 and the feed direction sliding surface 58*a* of the bearing member 58. As a result, the position of the lower portion of the carriage 50 in the feed direction is regulated, so that the carriage attitude is stabilized.

Further, the height position (level) of the carriage 50 with respect to the guide rail 52 in the vertical direction is switchably set by the contact of the lower portion of the carriage 50 or the lower portion of the bearing member 58 with the guide rail 52 by the carriage 50 under its own weight. In other words, in the case where the gap between the recording head 7 and the recording material is set to an ordinary small value, as shown in FIG. 3, a height direction sliding surface 50*b* of the carriage 50 is caused to contact the horizontal portion of the guide rail 52. In this state, while moving the carriage unit 5*a* along the guide rail 52 and the sliding portion 111 (main scanning), an image is formed by ejecting ink from the recording head 7 to the recording material by the signal from the electric portion 9. This state represents the case where the recording material is relatively thin, thus being used in the case of requiring a high image quality. The position of the carriage 50 in this state is referred to as an "ordinary position", and the gap in this state is referred to as an "ordinary gap".

The state of the bearing member 58 in this ordinary position will be described below.

In the ordinary position state, the bearing member 58 is urged toward the sheet feed direction by the bearing member spring 581 and slidably contacts the guide rail 52 at the sliding surface 58*a* in the feed direction. On the other hand, in the height direction, the sliding surface 58*b* of the bearing member 58 is higher in position (level) than the sliding surface 50*a* of the carriage 50, so that the bearing member 58 does not contact the guide rail 52. Further, between the bearing member 58 and the carriage 50, as shown in FIG. 4, a slidable member 583 slidable in the carriage movement direction is mounted. As shown in FIGS. 3-5, in the ordinary position state, the bearing member 58 is held at a rise position by upward urging springs 582 mounted between the bearing member 58 and the carriage 50. For this reason, in this state, the bearing member 58 does not contact the guide rail 52. Further, bearing member 58 is also urged downwardly by the urging springs 582 attached at both end portions of the bearing member 58, so that the bearing member 58 is also positioned in a downward direction with respect to the height direction. Further, the bearing member 58 is positioned in the main scanning direction with respect to the carriage 50 at points of the urging springs 582 at both end portions thereof.

In the neighborhood of the rear surface (on the feed direction upstream side) of the carriage 50, the slidable member 583 slidable between the carriage 50 and the bearing member 58 in the carriage movement direction is mounted. The slidable member 583 is an elongated member in a direction (main scanning direction) perpendicular to the sheet feed direction and is slidable in its lengthwise direction. Further, the slidable member 583 can be regulated in its position in the sliding direction by abutment at both end portions 583*a* and 583*b* thereof against a part of the apparatus main assembly (a side surface of the chassis 11 as shown in FIGS. 7 and 8) by moving the carriage 50. The slidable member 583 is positioned in the feed direction by being interposed between the carriage 50 and the bearing member 58 as shown in FIG. 6. Further, the position of the slidable member 583 in the height direction is determined in the upward direction by contact with the carriage 50 and determined in the downward direction by contact with the bearing member 58. These positionings are stabilized by the urging force of the springs acting between the carriage 50 and the bearing member 58.

Next, the switching operation of the gap between the recording head 7 and the recording material by the above constituted bearing member 58 and slidable member 583 will be specifically described with reference to FIGS. 7-10. FIGS. 7 and 9 show the state of the carriage unit 5*a* located at the ordinary position. When the recording on the recording material at the recording portion 5 is effected by the recording head 7, it is necessary to determine the position of the carriage unit 5*a* in the main scanning direction. For this purpose, first, the carriage 50 is moved in the left-hand direction in FIG. 7 to abut the left-hand end portion 583*a* of the slidable member 583 against the side surface of the chassis 11. By this abutment operation, an initial position of the carriage 50 is determined. In this state, the slidable member 583 is regulated in position by the abutment against the part of the chassis 50 in the sliding direction (main scanning direction), so that the slidable member 583 is not further slid (displaced) in a direction indicated by a solid black arrow shown in FIG. 7.

In this embodiment, as described above, the initial position determination of the carriage 50 is performed by the abutment of the end portion 583*a* of the slidable member 583. Instead of this, it is also possible to employ a constitution in which an end portion of the carriage 50 is abutted against the chassis 11, when the slidable member 583 is slid to some extent, to perform the initial position determination. According to this constitution, it is possible to realize a move accurate position determination by decreasing the number of parts interposed during the initial position determination. In such an ordinary position state, an ordinary recording operation with respect to an ordinary recording material having a thickness of not more than a certain value is performed.

On the other hand, in the case where the recording material is an envelope or thick paper having a thickness of more than the certain value or is formed of a material more liable to curl, it is necessary to increase the gap between the recording head 7 and the recording material. For this purpose, the position of the carriage 50 is required to be switched to a position higher than the ordinary position (ordinary gap position) at which the carriage 50 contacts the guide member 52. The higher position in this case is referred to as a "thick paper P". At the ordinary position shown in FIGS. 7 and 9, the carriage unit 5*a* contacts the guide rail 52 at the height direction sliding surface under its own weight. At this time, as described above, the bearing member 58 is located at the rise position by being urged upwardly by the springs 582. For this reason, the height direction sliding surface 58*b* of the bearing member 58 is located above the guide rail 52, so that it does not contact the guide rail 52.

The slidable member 583 changes a vertical position of the bearing member 58 relative to the carriage 50 by being regulated in its sliding position. An upward (carriage supporting) surface 583*f* formed at a part of the slidable member 583 always contacts a downward (receiving) surface 50*f* formed at a part of the carriage 50. In other words, the carriage 50 is supported by the slidable member 583 through the receiving surface 50*f* formed on the carriage 50 and the carriage supporting surface 583*f* formed on the slidable member 583. Accordingly, the relative position between the slidable member 583 and the carriage 50 in the vertical direction is not changed. On the other hand, at a downward surface of the slidable member 583, a cam surface 583*e* is formed and at an upward surface of the bearing member 58, a projection contact portion 58*e* contactable with the cam surface 583*e* is formed. By changing a sliding position of the slidable member 583 to change a contact position of the contact portion 58*e* with respect to the cam surface 583*e*, it is possible to change the vertical relative position of the bearing member 58 with respect to the carriage 50. Even in the case where the relative position is changed as described above, positional regulation is ensured in a stable state by the urging force of the springs exerted between the carriage 50 and the bearing member 58.

In the above described constitution, when the recording is effected at the thick paper position, the carriage unit 5*a* is moved toward the right-hand direction in FIGS. 7 and 8. By the movement, the right-hand end portion 583*b* of the slidable member 583 is caused to abut against the other (right-hand)

side surface of the chassis 11 which is a part of the apparatus main assembly. By this abutment, the slidable member 583 starts sliding in a direction indicated by a solid black arrow in FIG. 8. As a result, the bearing member 58 is moved in a direction indicated by a hatched arrow shown in FIGS. 8 and 10 by the cam surface 583*e* provided to the slidable member 583. That is, the bearing member 58 is displaced downwardly relative to the carriage 50. As a result, the sliding surface 58*b* of the bearing member 58 is located at a lower position than the sliding surface 50*b* of the carriage 50. For this reason, the bearing member 58 contacts the guide rail 52 at its sliding surface 58*b*, so that the carriage 50 is displaced to a position upwardly apart from the guide rail 52.

More specifically, by the abutment of the sliding surface 58*e* of the bearing member 58 against the guide rail 52, a reaction force is transmitted to the slidable member 583 through the cam surface 583*e* and further transmitted through the slidable member 583 to the carriage 50 which regulates the rise position. As a result, the carriage unit 5*a* (the carriage 50) is displaced in an upward direction indicated by an arrow with transverse lines shown in FIGS. 8 and 10. When the end portion 583*b* of the slidable member 583 is forcedly moved to this state by the side surface of the chassis 11 in the slid black arrow direction, the slidable member 583 abuts against a part of the carriage 50 at a part thereof, so that the slidable member 583 does not further slide. That is, the slidable member does not further move in the solid black arrow direction shown in FIG. 8. This state is the thick paper position at which the gap between the recording head 7 and the recording material is increased.

At this thick paper position, since the carriage 50 is moved from the ordinary position to the upper position, the height direction sliding surface 50*b* of the carriage 50 is spaced apart from the guide rail 52. Accordingly, the position of the carriage unit 5*a* at the thick paper position in the height direction is regulated by the height direction sliding surface 58*b* of the bearing member 58. In this state, while performing scanning with the carriage unit 5*a* in the main scanning direction, by ejecting ink from the recording head 7 on the basis of a signal from the electric portion 9, an image is formed with the ink ejected to a thick recording material such as an envelope or the like. The gap switching of the carriage unit 5*a*, i.e., the switching of the distance between the recording head 7 and the recording material in this embodiment is realized by the above described constitution and operation.

In this embodiment, the height position (level) of the bearing member 58 is switched by sliding the slidable member 583 in the carriage movement direction. This may also be realized by omitting the slidable member 583 and moving the carriage unit 5*a* by a manual operation by a user to switch the position of the carriage unit 5*a* from the ordinary position to the thick paper position. Further, when the carriage unit 5*a* is moved from the thick paper position to the ordinary paper position, similarly as described above, it is possible to easily realize the movement by abutting the carriage 50 against the part of the main assembly of the recording apparatus in the initial position determination of the carriage 50. Further, the switching between the ordinary position and the thick paper position may also be realized by moving the bearing member 58 by a manual operation by a user, so that the gap switching similar to that described above can be effected. As a result, it is possible to reduce the number of parts and improve an accuracy between the parts by the omission of the slidable member 583. Further, a similar gap switching can also be realized by manually moving the carriage 50 by a user, so that it is possible to simplify the driving mechanism.

According to this embodiment described above, such a constitution that the carriage 50 or the slidable member 583 on the carriage 50 is caused to abut against one of the side surfaces of the chassis 11 used for the initial position determination of the carriage 50 is employed. As a result, it is possible to set the carriage unit 5*a* to the ordinary position. Further, by causing the carriage 50 against the other side surface of the chassis 11, it is possible to set the carriage unit 5*a* to the thick paper position. That is, by utilizing the initial position determination performed at the time of the start of the recording, it is possible to always set the carriage unit 5*a* to the ordinary position. For this reason, without adding a sensor or a driving mechanism, it is possible to ensure gap setting of the carriage unit 5*a* with an inexpensive constitution.

By the above described constitution, various operations important in ensuring the height position of the carriage unit 5*a* can be stably performed. More specifically, not only an operation for keeping a quality of a recording image by proper gap setting of the recording head 7 but also a capping operation of the cap 61 at the refreshing process portion 6 shown in FIG. 1 and a refreshing operation such as wiping cleaning with the wiper 62 can also be stably performed. Further, it is possible to prevent a lowering in image quality by recording the image on the recording material, at the thick paper position, such as glossy paper to be subjected to recording at the ordinary position. Further, in this embodiment, the carriage unit 5*a* slides along the guide rail 52 at the height direction sliding surface 50*b* of the carriage 50 when it is located at the ordinary position and slides along the guide rail 52 at the height direction sliding surface 583*b* of the bearing member 58 when it is located at the thick paper position. According to such a constitution, at the ordinary position at which a recording quality is required, the carriage unit 5*a* can slide directly by the carriage 50, so that it is possible to obviate a lowering in accuracy due to an increase in the number of interposed parts.

Further, according to this embodiment, it is possible to switch the gap depending on a type or a size of the recording material selected on a driver. As a result, it is possible to automatically switch the gap only when the gap switching is required. Further, in this embodiment, the displacement of the carriage unit 5*a* in the height direction is performed only by parallel movement, so that the gap between the recording head 7 and the recording material, i.e., the height position (level) of the carriage 50 can be switched, without causing inclination of the attitude of the carriage 50 (or the recording head 7) with respect to the recording surface of the recording material, while ensuring a parallel state between the recording head 7 and the recording material. As a result, it is possible to reliably prevent the lowering in recording image quality during the gap switching, so that higher quality image recording can be effected.

In the above described embodiments, the ink jet recording apparatus for recording an image by ejecting ink from the recording head is described as an example. However, the present invention is not limited thereto but may also be similarly applicable to recording apparatuses using other recording methods so long as the recording apparatus requires setting of the gap between the recording head and the recording material. Further, the present invention is also similarly applicable irrespective of the number of recording heads and their arrangements and constitutions. In the case of the ink jet recording apparatus, it is further applicable similarly regardless of a type and property of ink used. Further, the present invention is not restricted to a single apparatus such as a printer, a copying machine, a facsimile apparatus, an image pickup and forming apparatus, or the like. In other words, the present invention is widely applicable to recording apparatuses such as multi-function apparatuses having functions of the above described apparatuses, and a multi-function apparatus for a computer system. With respect to the recording material, the present invention is applicable to any material, irrespective of types or forms of the material so long as the material is capable of recording thereon an image, in addition to the above described materials (paper, cloth, plastic sheet, OHP sheet, envelope, etc.).

As described hereinabove, according to the present invention, it is possible to provide a recording apparatus capable of easily switching the gap between the recording head and the recording material, without causing inclination of the carriage with respect to the recording material, with a simple and inexpensive constitution and capable of high-quality image recording regardless of a type of the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 132415/2006 filed May 11, 2006, which is hereby incorporated by reference.

What is claimed is:

1. A recording apparatus for effecting recording on a recording material with a recording head mounted on a carriage movable along the recording material, said recording apparatus comprising:

a guide member for guiding the carriage;

a platen for guiding the recording material at a position opposite to the recording head;

a bearing member, mounted to the carriage, movable relative to the carriage in a vertical direction; and a slidable member mounted slidably in a carriage movement direction between the carriage and said bearing member, wherein said slidable member is slid in the carriage movement direction to move said bearing member relative to the carriage thereby to change a distance between the recording head and said platen.

2. An apparatus according to claim 1, wherein the gap between the recording head and said platen is changed by switching between a contact state between the carriage and said guide member and a contact state between said bearing member and said guide member.

3. An apparatus according to claim 1, wherein said slidable member contacts the carriage at an upper surface thereof and contacts said bearing member at a lower surface thereof, and wherein a cam surface for changing a relative position between the recording head and said platen with respect to the vertical direction is located between said slidable member and said bearing member.

4. An apparatus according to claim 1, wherein said slidable member is caused to abut against a part of a main assembly of said recording apparatus by moving the carriage by drive of a driving source to be slid relative to said bearing member.

5. An apparatus according to claim 1, wherein said slidable member is caused to abut against a part of a main assembly of said recording apparatus by moving the carriage by a user to be slid relative to said bearing member.

6. An apparatus according to claim 1, wherein the distance between the recording head and said platen is set depending on a type of the recording material.

7. An apparatus according to claim 1, wherein said slidable member is slid by an operation by a user when the distance between said recording head and said platen is increased and is slid by drive of a driving source when the distance between said recording head and said platen is decreased.

8. An apparatus according to claim 1, wherein said recording head is an ink jet recording head for recording an image by ejecting ink from an ejection outlet to the recording material on the basis of image information.

* * * * *